US005895081A

United States Patent [19]

Tanimoto et al.

[11] Patent Number: 5,895,081

[45] Date of Patent: Apr. 20, 1999

[54] INSIDE DOOR HANDLE ASSEMBLY FOR VEHICLES

[75] Inventors: Tetsurou Tanimoto, Anjyo; Morihito Nomura, Toyota; Kouji Ooe, Nagoya; Kouichi Nagata, Oobu; Katsuaki Maruyama, Toyota; Masayuki Nomura, Aichi-ken; Akira Matsuura, Toyota, all of Japan

[73] Assignee: Aisin Seiki Kabushiki Kaisha, Japan

[21] Appl. No.: 08/949,033

[22] Filed: Oct. 10, 1997

Related U.S. Application Data

[63] Continuation-in-part of application No. 08/636,589, Apr. 23, 1996, abandoned.

[30] Foreign Application Priority Data

Apr. 24, 1995 [JP] Japan ..... 7-098691

[51] Int. Cl.[6] ..... E05B 3/00

[52] U.S. Cl. ..... 292/348; 292/352; 292/336.3

[58] Field of Search ..... 292/336.3, 347, 292/DIG. 31, 346, 348, 351, 352, 354; 384/125, 539

[56] References Cited

U.S. PATENT DOCUMENTS

| | | | |
|---|---|---|---|
| 2,750,217 | 6/1956 | Landholt | 292/DIG. 31 |
| 3,528,695 | 9/1970 | Peters | 292/336.3 |
| 3,544,148 | 12/1970 | Sandor | 292/336.3 |
| 3,795,416 | 3/1974 | Hehl et al. | 292/336.3 |
| 4,038,718 | 8/1977 | Reilhac et al. | 16/110 RT |
| 4,580,821 | 4/1986 | Genord, Jr. et al. | 292/336.3 |
| 4,580,822 | 4/1986 | Fukumoto | 292/336.3 |
| 4,838,590 | 6/1989 | Isomura | 292/336.3 |
| 4,892,342 | 1/1990 | Newman et al. | 292/347 |
| 4,993,763 | 2/1991 | Tanimoto et al. | 292/336.3 |
| 5,011,202 | 4/1991 | Kato et al. | 292/336.3 |
| 5,129,694 | 7/1992 | Tanimoto et al. | 292/347 |
| 5,236,148 | 8/1993 | Valentine | 242/239 |
| 5,263,750 | 11/1993 | Smith et al. | 292/336.3 |

FOREIGN PATENT DOCUMENTS

| | | |
|---|---|---|
| 3-43852 | 9/1991 | Japan . |
| 4-16268 | 2/1992 | Japan . |
| 6-7196 | 2/1994 | Japan . |

*Primary Examiner*—Steven N. Meyers
*Assistant Examiner*—Gary Estremsky
*Attorney, Agent, or Firm*—Finnegan, Henderson, Farabow, Garrett & Dunner, L.L.P.

[57] ABSTRACT

An inside door handle assembly includes a handle rotatably held on a base to be secured to a vehicle's door and a knob rotatably held on the base. The base has first, second and third upright walls. The handle is disposed with respect to the first and second upright walls to cover the top of the second upright wall and the knob is disposed with respect to the second and third upright walls. The lateral movement of the handle is limited by the knob, thereby preventing the handle from becoming detached from the base.

5 Claims, 4 Drawing Sheets

INSIDE DOOR HANDLE ASSEMBLY FOR VEHICLES

This application is a continuation, of application Ser. No. 08/636,589 filed Apr. 23, 1996, now abandoned.

BACKGROUND OF THE INVENTION

The present invention relates to an inside door handle assembly for vehicles, and more particularly to an inside door handle assembly having a handle to open or close a door and a knob to keep the door in a closed state.

An example of an inside door handle assembly according to a prior art is disclosed in Japanese Utility Model Laid Open Publication No. 16268/1992. This conventional inside door handle assembly comprises a base secured to a vehicle's door, a handle rotatably held on the base and able to be turned in a direction to open the door, a knob rotatably supported on the base and able to keep the door in a locked state, and a spring biasing at all times the handle in a direction to accommodate the handle in a space of a bezel. The handle is connected to an opening lever of a door lock mechanism and positioned between first and second upright walls of the base. The knob is coupled also to a locking lever of the door lock mechanism and disposed between the second and third upright walls.

In the conventional inside door handle assembly, the handle and the knob are rotatably held on the base by means of a pin passing therethrough.

This type of conventional assembly is disclosed in Japanese Utility Model Publication Nos. 7196/1994 and 43852/1991. These conventional assemblies use projections integral with the base and corresponding through-holes formed on the handle and the knob and adapted to receive the projections in place of the pin. The combination of the projections and the through-holes is useful in saving the pin, but necessary to provide a device for preventing the handle from becoming detached from the base. Thus, the assembly of the conventional inside door handle is a laborious and time consuming task.

SUMMARY OF THE INVENTION

An object of the present invention is to provide an inside door handle assembly for vehicles which overcome problems encountered in a prior art.

Another object of the present invention is to provide an inside door handle assembly for vehicles which is simple in construction and easy to assemble.

To achieve the objects and in accordance with the purpose of the invention, as embodied and broadly described herein, there is provided an inside door handle assembly for a vehicle comprising a base adapted to be fixedly secured to a door of a vehicle and having at least three spaced upright walls, a handle rotatably retained by the first upright wall and the second upright wall of the base, the second upright wall being positioned between the first upright wall and the third upright wall, a knob freely rotatably retained by at least the third upright wall of the base, a spring arranged to be held at one end on the handle and at the other end on one of the upright walls, the first and second upright walls having first and second projections integral therewith, respectively, which laterally protrude toward the third upright wall of the base and are rotatably fitted in through-holes formed on opposed mounting walls of the handle by sliding the handle in an axial direction, the third upright wall having a third projection which fits in a through-hole formed on a mounting wall of the knob, and the top of the second upright wall being covered with the handle, the second upright wall being positioned between the opposed mounting walls of the handle.

When the handle is to be held on the base, the handle is moved from a place substantially normal to the common axis of the first and second projections to a position where the common axis of the corresponding through-holes of the handle is aligned with the common axis of the projections of the base, and moved laterally to fit the projections in the corresponding through-holes, thereby rotatably supporting the handle on the base.

When the knob is to be held on the base, the knob is moved from a place substantially normal to the axis of the third projection of the base to a position where the axis of the corresponding through-hole of the knob is aligned with the axis of the third projection and moved laterally to insert the third projection into the corresponding through-holes, thereby rotatably supporting the knob on the base. It is noted that one side surface of the handle is positioned as closely as possible to one side surface of the knob so that the lateral movement of the handle is regulated or limited to prevent the handle from being detached from the base. Thus, the device for preventing the handle from being detached from the base is unnecessary and the assembly of the handle and the knob with respect to the base is provided quite simply in a short time.

Other features and advantages of the present invention will be apparent from the following description taken in conjunction with the accompanying drawings.

DESCRIPTION OF THE PREFERRED EMBODIMENT

A preferred embodiment of the present invention will be described with references to the drawings.

Figure 1:
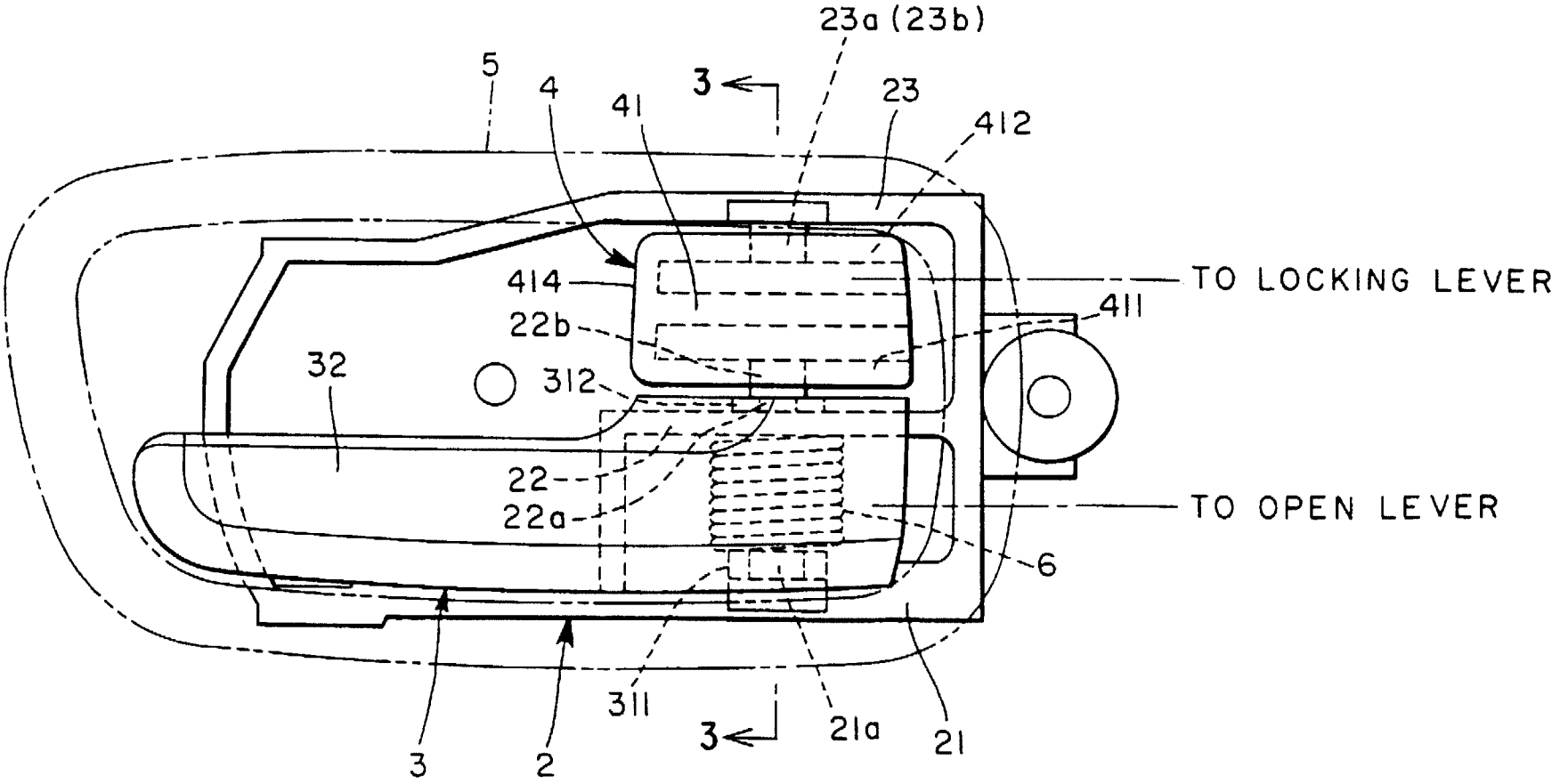
FIG. 1 is a plan view illustrating a preferred embodiment of an inside door handle assembly for vehicles according to the present invention.
Figure 2:
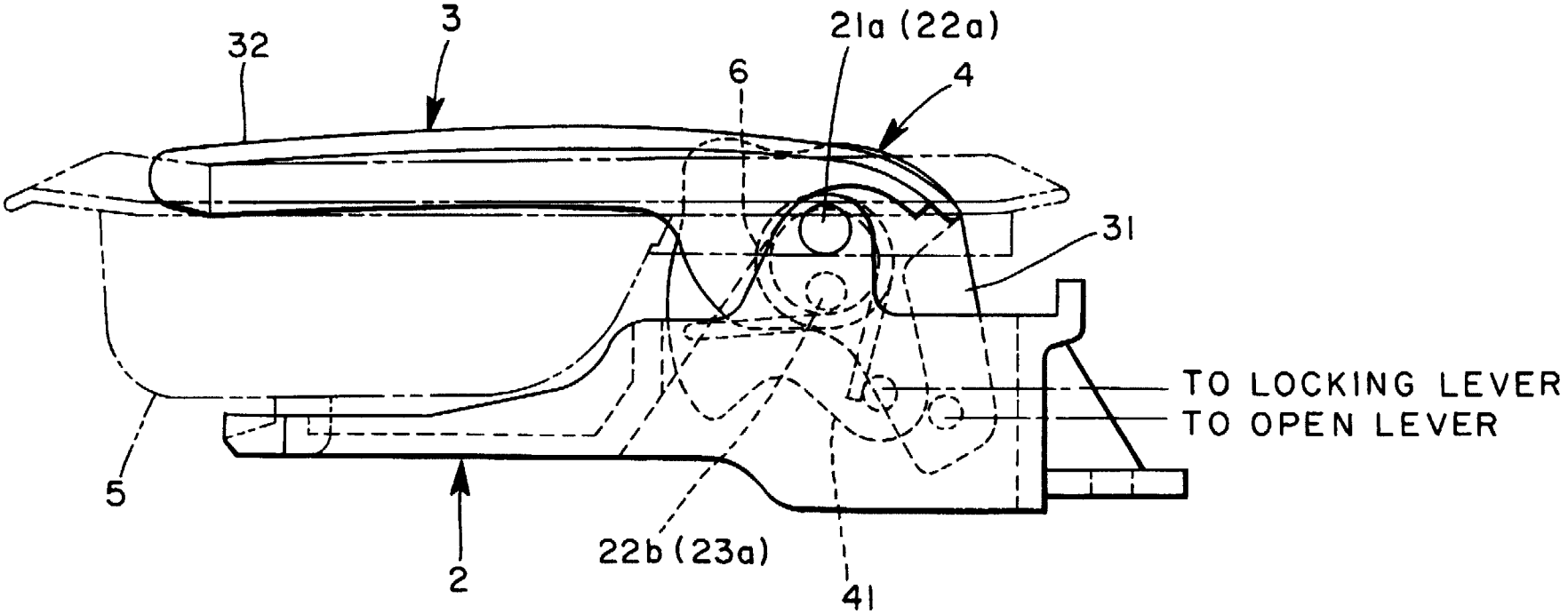
FIG. 2 is a side view of the inside door handle assembly illustrated in FIG. 1.
Figure 3:
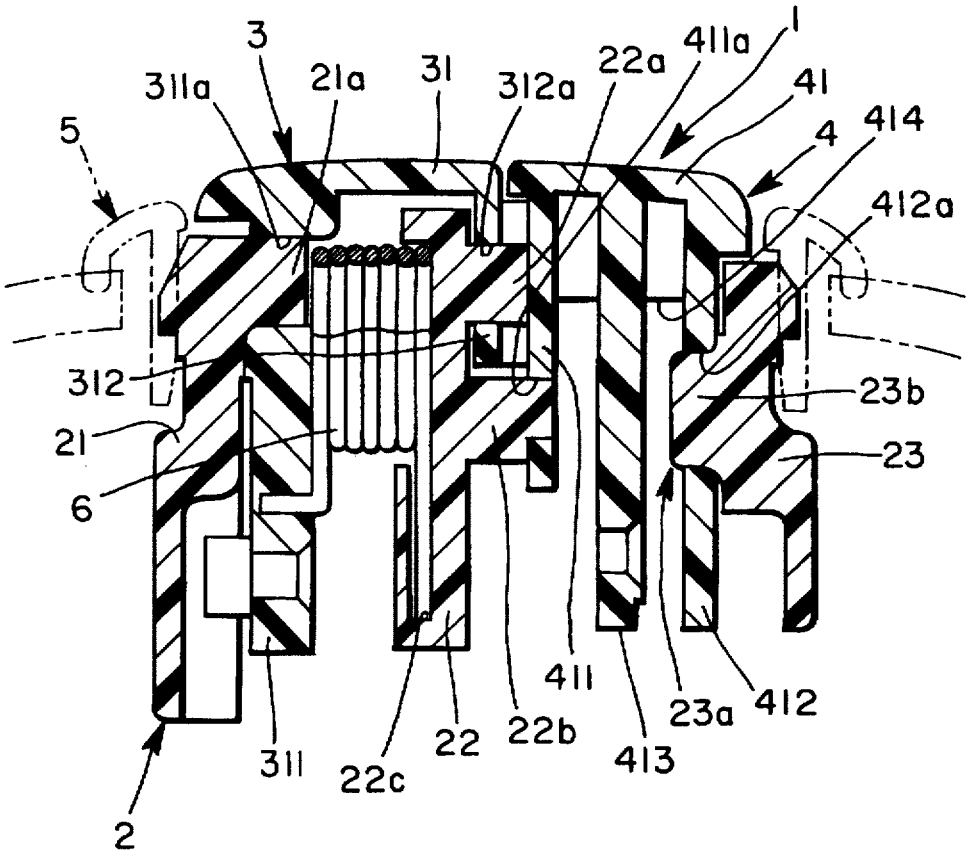
FIG. 3 is a sectional view taken along an arrow 3—3.

As illustrated in FIGS. 1 through 3, an inside door handle assembly 1 for vehicles includes a base 2 in the form of a rectangle and having at least three upright walls 21, 22, 23, a handle 3 rotatably held on the base 2 by using the first and second upright walls 21, 22, a knob 4 rotatably held on the base 2 by using the second and third walls 22, 23, a bezel 5 accommodating the handle 3 and the knob 4 in an interior space thereof The base 2 and the bezel 5 are secured to the door. The first and second upright walls 21, 22 of the base 2 are formed with projections 21*a*, 22*a*, respectively and the second and third upright walls 22, 23 are formed with projections 22*b*, 23*a*, respectively. The projection 22*b* has parallel flat side surfaces 23*b* thereon (see FIG. 4). The projection 22*b* may be omitted from the upright wall 22.

The handle 3 is composed of an arm portion 31 which is coupled to an open lever of a door lock mechanism and a grip portion 32 integral with the arm portion 31. The arm portion 31 of the handle 3 is provided with mounting walls 311, 312 having coaxial through-holes 311*a*, 312*a*. A spring 6 disposed between the second upright wall 22 and the mounting wall 311 is held at one end on the second wall 22 and at the other end on the mounting wall 311 so as to urge the handle 3 in a direction to accommodate the handle 3 in an interior space of the bezel 5.

Figure 4:
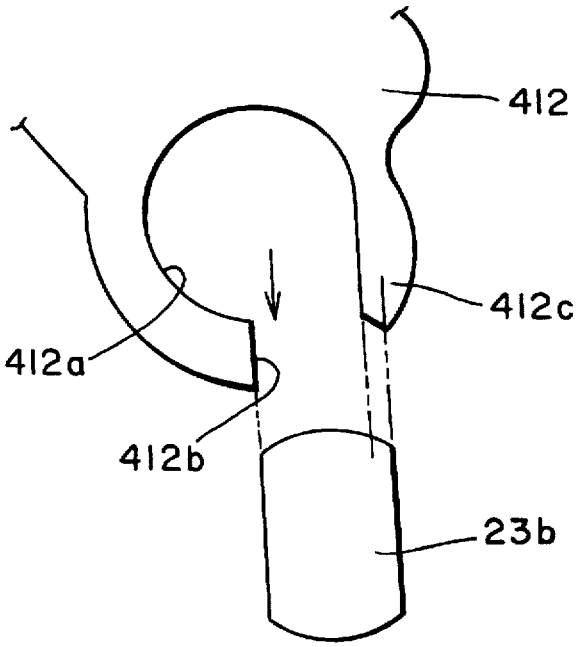
FIG. 4 is a partially enlarged view illustrating a part of a knob.

The knob 4 has an arm portion 41 which is connected to a locking lever of the door lock mechanism and has three mounting walls 411, 412, 413 and a connecting wall 414 (see FIG. 1). The mounting walls 411, 412 are formed with co-axial through-holes 411*a*, 412*a*. As shown in FIG. 4, the wall for defining the through-hole 412*a* is provided with a cut-out portion 412*b* so that a part 412*c* of the hole defining wall is deformable. The width of the cut-out portion 412*b* is smaller than a size between the parallel flat side of surfaces 23*b*. By pushing the connecting wall 414 the knob 4 can be operated to lock or unlock the door.

Figure 5:
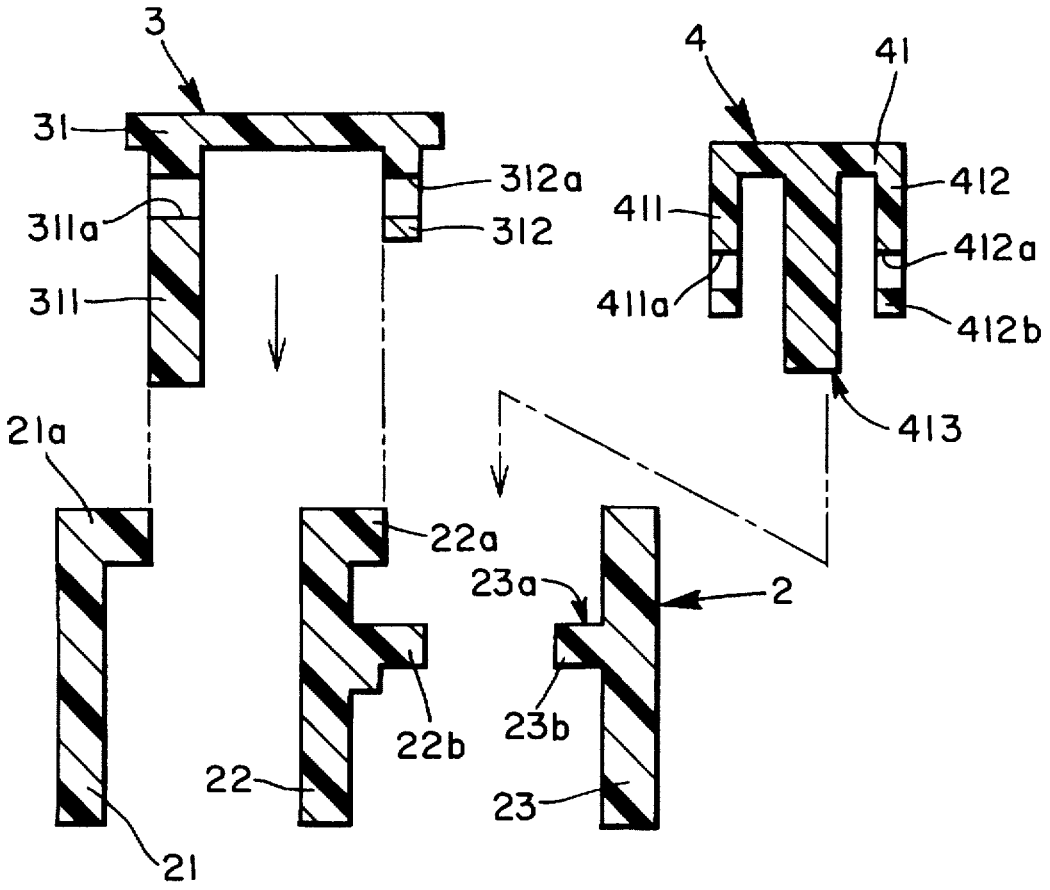
FIG. 5 is a view illustrating how to assemble respective parts for the inside door handle assembly.

When the handle 3 and the knob 4 is to be assembled with respect to the base 2, the handle 3 is moved from a place (see FIG. 5) substantially normal to the common axis of the first and second projections 21*a*, 22*a* to a position where the common axis of the corresponding through-holes 311*a*, 312*a* is in alignment with the axis of the projections 21*a*, 22*a*. After that, the handle 3 is laterally moved with respect to the base 2 to fit the projections 21*a*, 22*a* in the corresponding through-holes 311*a*, 312*a*, thereby rotatably supporting the handle 3 to the base 2 in such a fashion that the top of the upright wall 22 is covered with the handle 3.

When the knob 4 is to be held on the base 2, the knob 4 is moved from a place (see FIG. 5) substantially normal to the common axis of the projections 22*b*, 23*b* to a position where the common axis of the corresponding through-holes 411*a*, 412*a* is aligned with the axis of the projections 22*b*, 23*b*. After that, the knob 4 is laterally moved with respect to the base 2 to insert the projections 22*b*, 23*b* into the corresponding through-holes 411*a*, 412*a*, thereby rotatably supporting the knob 4 to the base 2. As a result, the handle 3 is disposed between the upright wall 21 of the base 2 and the mounting wall 411 of the knob 4 so that the mounting wall 411 comes into abutment contact with the projection 22*a* and the lateral movement of the handle 3 which causes the handle 3 to be detached from the base 2 is prevented. Further, the detachment of the knob 4 from the base 2 is prevented by the wall 412*c*.

Figure 6:
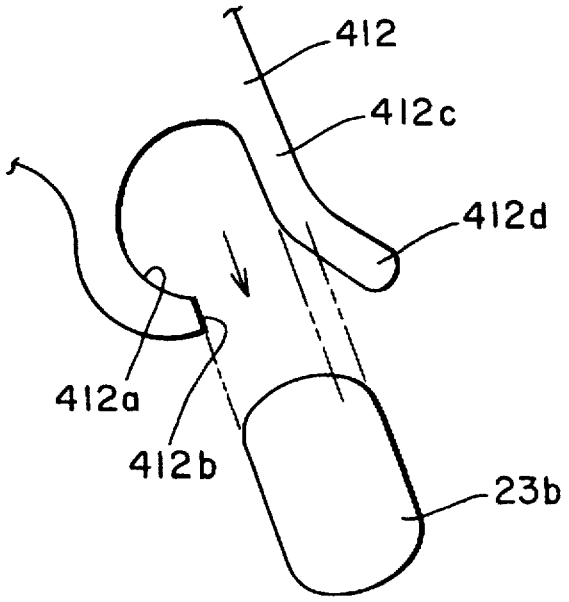
FIG. 6 is a partially enlarged view illustrating another example of the knob.

As illustrated in FIG. 6, the mounting wall 412 may be provided with a guide wall 412*d* which is continuous with the deformable wall 412*c* and useful in introducing the projection 23*b* of the third upright wall 23 into the through-hole 412*a* of the knob 4.

As many apparently widely different embodiments of the present invention can be made without departing from the spirit and scope thereof, it is to be understood that the invention is not limited to the specific embodiments thereof except as defined in the appended claims.

What is claimed is:

1. An inside door handle assembly for a vehicle comprising:

a base adapted to be fixedly secured to a door of a vehicle and having at least three spaced upright walls;

a handle rotatably retained by the first upright wall and the second upright wall of the base, the second upright wall being positioned between the first upright wall and the third upright wall;

a knob freely rotatably retained by at least the third upright wall of the base, and a spring arranged to be held at one end on the handle and at the other end on one of the upright walls;

the first and second upright walls having-first and second projections integral therewith, respectively which laterally protrude toward the third upright wall of the base and are rotatably fitted in through-holes formed on opposed mounting walls of the handle by sliding the handle in an axial direction, the third upright wall having a third projection which fits in a through-hole formed on a mounting wall of the knob, and the top of the second upright wall being covered with the handle, the second upright wall being positioned between the opposed mounting walls of the handle, the knob being in abutment with the second projection of the second upright wall of the base to prevent lateral movement of the handle off of the first and second projections.

2. An inside door handle assembly for a vehicle comprising:

a base adapted to be fixedly secured to a door of a vehicle and having at least three spaced upright walls;

a handle rotatably retained by the first upright wall and the second upright wall of the base;

a knob freely rotatably retained by the second and third upright walls of the base;

a spring arranged to be held at one end on the handle and at the other end on one of the upright walls;

the first and second upright walls having first and second projections which are fitted in through-holes formed on opposed mounting walls of the handle, the knob having means for preventing lateral movement of the handle off of the first and second projections;

the second and third upright walls having third and fourth projections which fitted in through-holes formed on opposed mounting walls of the knob, the third projection having parallel flat side surfaces, and the through-hole formed on one of the opposed mounting walls of the knob having an opening thereon wherein the third projection is inserted into the through-hole of the knob through the opening, the width of the opening being smaller than the distance between the parallel flat side surfaces of the third projection.

3. An inside door handle assembly for a vehicle comprising:

a base adapted to be fixedly secured to a door of a vehicle and having at least three spaced upright walls;

a handle rotatably retained by the first upright wall and the second upright wall of the base;

a knob freely rotatably retained by at least the third upright wall of the base;

a spring arranged to be held at one end on the handle and at the other end on one of the upright walls;

the first and second upright walls having first and second projections, respectively, which laterally protrude toward the third upright wall of the base and fit in through-holes formed on opposed mounting walls of the handle, the knob being in abutment with the second projection to prevent lateral movement of the handle off of the first and second projections;

the third upright wall having a third projection which fits in a through-hole formed on a mounting wall of the knob, said third projection having parallel flat side surfaces, and the through-hole formed on the mounting wall of the knob being opened through a cut-out portion to allow the third projection to be inserted into the through-hole of the knob through the cut-out portion; and the top of the second upright wall being covered with the handle.

4. An inside door handle assembly according to claim 3, wherein the wall defining the through-hole having the cut-out portion is deformable.

5. An inside door handle assembly according to claim 4, wherein the dimension between the parallel flat side surfaces of the third projection is larger than the dimension in the width of the cut-out portion.

* * * * *